United States Patent [19]

Hagler

[11] Patent Number: 4,700,627

[45] Date of Patent: Oct. 20, 1987

[54] METHOD AND APPARATUS FOR MARKING DEFECTIVE PORTIONS OF A PRINTED WEB

[75] Inventor: Andrew J. Hagler, Rochester, N.Y.

[73] Assignee: Case-Hoyt, Rochester, N.Y.

[21] Appl. No.: 823,202

[22] Filed: Jan. 28, 1986

[51] Int. Cl.[4] ..... B41F 3/42

[52] U.S. Cl. ..... 101/426; 101/2; 101/181

[58] Field of Search ..... 101/DIG. 1, 2, 212, 101/216, 219, 221, 225, 224, 178–181, 426, 232, 247; 226/10, 12, 24, 33, 45

[56] References Cited

U.S. PATENT DOCUMENTS

| | | | |
|---|---|---|---|
| 3,289,835 | 12/1966 | Dalin | 209/125 |
| 3,329,087 | 7/1967 | Sandor et al. | 101/181 |
| 3,806,075 | 4/1974 | Nachioff et al. | 226/33 |
| 3,955,502 | 5/1976 | Hofe | 101/181 |
| 3,974,766 | 8/1976 | Zimmer | 101/426 |
| 4,011,975 | 3/1977 | Brown, Jr. | 226/33 |
| 4,067,760 | 1/1978 | Nelson | 101/181 X |
| 4,243,925 | 1/1981 | Gnuechtel | 101/181 X |
| 4,541,335 | 9/1985 | Tonuno et al. | 101/219 |
| 4,541,337 | 9/1985 | Schaul | 101/181 |

FOREIGN PATENT DOCUMENTS

| | | | |
|---|---|---|---|
| 1212563 | 3/1966 | Fed. Rep. of Germany | 101/181 |
| 2058424 | 5/1972 | Fed. Rep. of Germany | 101/181 |
| 2323792 | 5/1973 | Fed. Rep. of Germany | 101/181 |
| 130775 | 5/1978 | German Democratic Rep. | 101/181 |
| 93154 | 6/1982 | Japan | 101/181 |
| 14959 | 1/1984 | Japan | 101/181 |
| 145151 | 8/1984 | Japan | 101/181 |
| 96461 | 5/1985 | Japan | 101/181 |
| 155465 | 8/1985 | Japan | 101/181 |

*Primary Examiner*—E. W. Eickholt

*Attorney, Agent, or Firm*—Shlesinger, Arkwright & Garvey

[57] ABSTRACT

A printed web marker is used in combination with a multiroll printing press. A web marker is positioned downstream of the last of the rolls for marking defective portions of the printed web. A central controller operates the marker and the controller has off, delay and on control modes. The marker does not operate when in the off mode and marking commences upon expiration of a predetermined period when the controller is shifted from the off to the delay mode and continues thereafter and for a predetermined period after the controller is shifted from the delay to the off mode. Marking commences instantaneously upon the controller being shifted from the off to the on mode. Switches and operators cause the controller to be shifted between the modes so that only defective portions of the web are marked.

21 Claims, 4 Drawing Figures

METHOD AND APPARATUS FOR MARKING DEFECTIVE PORTIONS OF A PRINTED WEB

BACKGROUND OF THE INVENTION

High quality printing of a web, such as a continuous paperstrip, in a conventional multi-roll printing apparatus can only be achieved when tight control over the operating parameters is maintained. Should this control be lacking or should a transient malfunction occur, then a defect will be visually apparent. Such defects include out-of-registration print, hickie marks, splice marks, blanket wash marks and the like. Those portions of the web having these defects are not suitable for distribution to the customer and must be separated from the remaining good portions.

Conventional printing presses operate at high rates with speeds of up to 300 to 1000 revolutions per minute, thereby rapidly printing large quantities of paper. Those skilled in the art realize, therefore, that a defect, if not immediately corrected, can rapidly ruin a tremendous amount of paper, at a resultant large cost. These defects, such as out-of-registration print and hickie marks, are apparent only by selective inspection of the material (pulling a sample out and examining for defects) coming from the press. Correction takes time and requires clear-up of the print rolls after removal of a piece of dust, paper etc. caught on the rolls. Thus, the operator, in correcting the defect, causes a transient defect. Shut down and start up of any press causes a great deal of time loss and expense and, therefore, defect correction is normally done while the press is running, even though there are some waste losses.

Additionally, a defect is caused by the splice created by the splicer which joins the end of a spent roll to the end of a new roll. This splice joint creates an undesirable transient distortion in the print image. Another source of defect results from the periodic cleaning or washing of the print cylinders.

In view of the above, it can be appreciated that there is a need for a method and apparatus which permits defective portions of a printed web to be marked for ease in inspection without requiring selective sampling. The defective portions then can be easily separated from the good portions with a minimum of waste while permitting the press to continue to operate. Dalin, U.S. Pat. No. 3,289,835, discloses a marking apparatus for a newspaper printing machine wherein the front page of a completed and folded defective newspaper is marked. The solution suggested by Dalin is not satisfactory for high speed printing presses. Dalin fails to take into account the defective portion in the press and the time required for that portion to pass through the press. Also, Dalin involves inspection after all operations have been completed.

OBJECTS AND SUMMARY OF THE INVENTION

The primary object of the disclosed invention is to provide a method and apparatus for marking defective portions of the printed web for quick visual inspection during press operation, which invention avoids selective inspection as in the past, and permits substantial reduction of waste.

An additional object of the disclosed invention is to provide an apparatus which selectively controls operation of the web marker in a multi-color printing operation.

Another object of the disclosed invention is to provide a method and apparatus utilizing marking fluids which are invisible to the eye but which may be illuminated by light of a selected spectrum so that all marked products need not be discarded.

Another object of this invention is to provide an inexpensive web marking method and apparatus which can be readily adapted to existing equipment and which is easy to maintain.

A further object of this invention is to provide a web marking apparatus and method which will mark the web for a predetermined period of time and automatically shut off the marking system at the end of such time.

Still a further object of this invention is to provide a web marking apparatus and method which will be automatically turned on and mark the web when a predetermined condition exists.

Yet another object of this invention is to provide a web marking apparatus and method which can be manually set for operation and which will continue to operate for a predetermined period after manual operation has been instituted.

A still further object of this invention is to provide a web marking apparatus and method which can be adjusted to operate for various time periods either by controlled counting of print roll turns or by timer mechanism.

In summary, the disclosed invention provides a method and apparatus for operating a printed web defect marker which is utilized in combination with a single or multi-roll printing press or the like.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
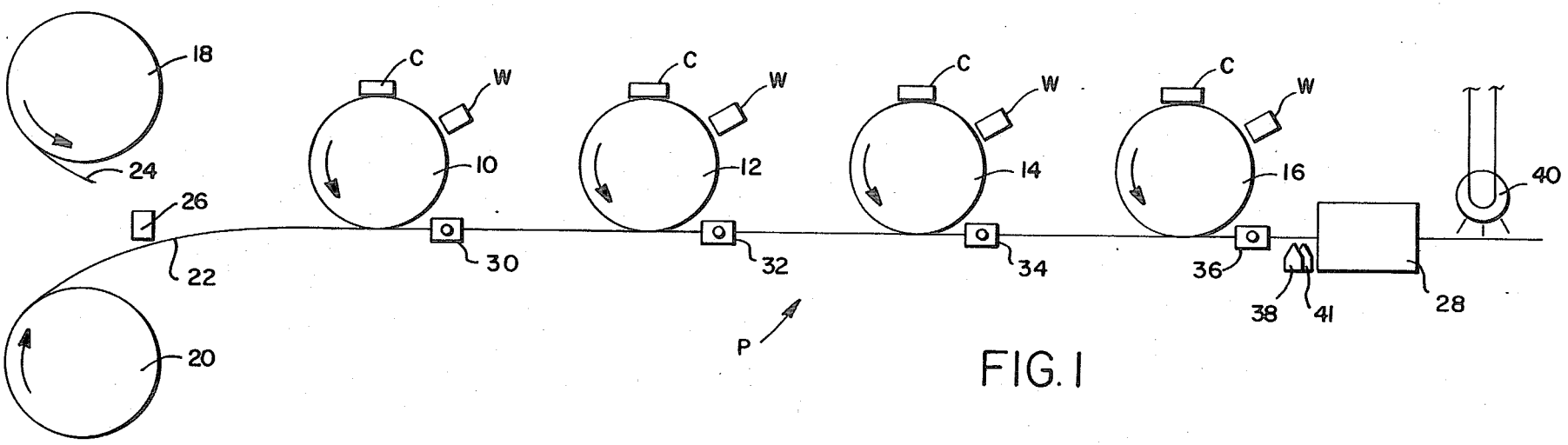
FIG. 1 is a diagrammatic side elevational view of a printing apparatus incorporating the invention.

Printing press P, as best shown in FIG. 1, has rotatable print cylinders 10, 12, 14 and 16. Feed rolls 18 and 20 are disposed upstream of print cylinder 10 and carry the paper web on which the cylinders 10, 12, 14 and 16 imprint their respective color images. As shown in FIG. 1, web 22 is fed from rotatable feed roll 20 to printing apparatus P while web 24, wound around feed roll 18, awaits passage through the automatic splicer 26 which splices the end of web 24 to the spent end of web 22. Preferably, oven 28 is disposed downstream of print cylinder 16 and drys the print registrations and the marking fluid, as will be further explained.

Preferably, each of print cylinders 10, 12, 14 and 16 has an adjustable counter C or timer which monitors the number of revolutions of the associated print cylinder or which times the web feed. Furthermore, each of the print cylinders 10, 12, 14 and 16 has a blanket washer W which cleans the print cylinders 10, 12, 14 and 16 on a simultaneous periodic basis.

Proximate each of print cylinders 10, 12, 14 and 16 is a manually operated switch 30, 32, 34 and 36, respectively. Each of switches 30, 32, 34 and 36 is proximate the associated print cylinder and the press operator (not shown) can observe the imprint deposited upon the web 22 from the associated one of the cylinders 10, 12, 14 and 16 while located at the respective switches 30, 32, 34 and 36. Each of the switches 30, 32, 34 and 36 is in electrical connection with a central controller, as will be further explained, and the activation of a switch 30, 32, 34 or 36 causes spray applicator 38 to direct a spray of marker fluid, which preferably is a fluorescent fluid, to one side edge of the web 22. The spray applicator 38 is immediately downstream of print cylinder 16 and upstream of oven 28 so that the fluorescent fluid, as well as the printed registrations, will be dryed in the oven 28. It has been found that the fluorescence is enhanced by the oven 28. Lamp 40 emits ultraviolet or infrared radiation and causes the dryed fluorescent fluid to luminesce so as to be visible. This permits the marked web to be quickly and easily differentiated and separated from the unmarked web so that only high quality printing will be sent to a customer. A second spray applicator 41 may be used to apply visible ink to the web for specific marking purposes, if necessary, when index marking is used for edge marking of printing for a specific job.

The disclosed apparatus and method is most advantageously utilized on a printing press P which is used to print and assemble multicolored brochures, folded inserts and the like. Such printed articles require high quality, typically glossy, printing and the customer will not tolerate improper registration and the like of the printed impressions. Such material is customarily imprinted on a web which has a width exceeding the width of the printed article. Therefore, a small margin, of approximately $\frac{1}{4}$ inch, extends along either side edge of the web 22. The spray applicator 38 directs the fluorescent fluid onto this unprinted margin so that the fluorescent fluid does not come into contact with the printed image. Therefore, it is then possible to inspect the sorted defective webs to determine if any are, in fact, suitable for use. Since the fluorescent fluid has not distorted the printed matter, these additional items may be further processed.

Figure 2:
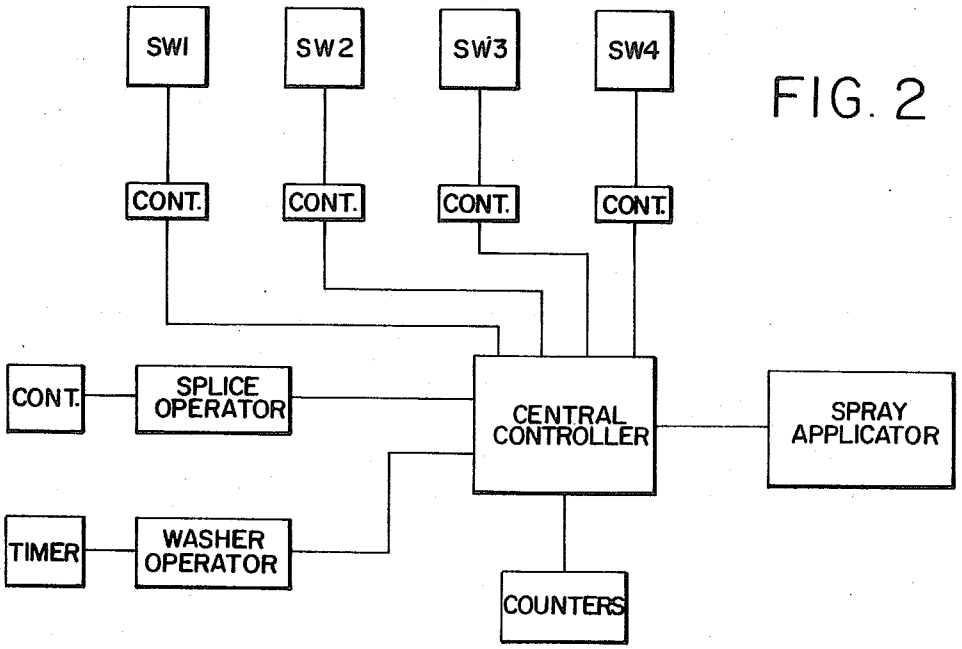
FIG. 2 is a block diagram of the control circuit of the invention.

FIG. 2 discloses an elemental diagram of the control system of the invention. Switches SW1, SW2, SW3 and SW4, which correspond to switches 30, 32, 34 and 36, are in electrical connection with the central controller, which preferably includes a microprocessor. The control controller is operably connected to the spray applicators, which correspond to applicators 38 and 41, and causes the applicators to operate and to direct their respective fluids toward the web. Preferably, each of the switches, SW1, SW2, SW3 and SW4 has a local controller which permits independent selection of a predetermined delay period. Those skilled in the art will appreciate that the central controller may be programmed for these delays so that hardware may be minimized. This delay period is based upon the distance of the respective print cylinders 10, 12, 14 and 16 from the closely adjacent spray applicators 38 and 41, as will be further explained.

Splicer 26 has an operator which is also in electrical connection with the central controller. The splicer operator has a local controller which also allows a preselected delay to be built into the signal transmitted therefrom, as will be further explained. As explained above, the central controller may be programmed for the delay. The wash operator which controls the operation of the washers W is also in electrical connection with the central controller and has a timer which causes the washer operator to operate for a preselected time period. Finally, the counters C are in electrical connection with the central controller so that the number of revolutions of the respective print cylinders 10, 12, 14 and 16 can be monitored and transmitted to the central controller so that the appropriate delay can be factored in for causing proper operation of the spray applicators.

Figure 3:
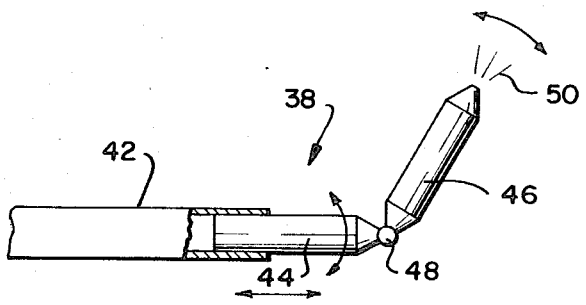
FIG. 3 is a side elevational view with portions broken away disclosing the spray apparatus of the invention; and, FIG. 4 is a functional logic diagram of the algorithm operating the control circuit of the invention.

The spray applicator 38 is better shown in FIG. 3 and includes a cylinder 42 in which displacable piston 44 is received. It can be noted that piston 44 is rotatable on the longitudinal axis thereof, as well as being translatable along that axis, so that the spray applicator 38 can accomodate webs 22 of varying width. Spray nozzle 46 is connected to piston 44 through swivel joint 48 so that the angle of application of the fluorescent fluid 50 can be altered. In this way, the spray applicator 38 permits the fluid 50 to be directed onto the web 22 as desired, so that webs of varying thickness, width and running speed may be accomodated.

Those skilled in the art will appreciate that operation of splicer 26, as indicated to the central controller by the splicer operator, may cause defective print impressions by the print cylinders 10, 12, 14 and 16 because of the splice passing therethrough. A number of revolutions of the print cylinders 10, 12, 14 and 16, which number of revolutions is based, in part, upon the size of the cylinders, is required to clear this splice-caused defect so that an accurate high quality registration will be imprinted onto the web 22. Therefore, it is desirable that the applicator 38 spray the defective portions only and cease operation after the desired number of revolutions of the print cylinder has occurred. Applicant has discovered that between 30 to 60 revolutions of the print cylinders are required for passage of the splice through the printing press P, and that an average of 40 to 50 revolutions are required for such passage. Approximately 9 revolutions of the print cylinders are required to clear the defect caused by passage of the splice through the press P. Therefore, the local controller on the splice operator, which automatically communicates with the central controller when the splice operation has commenced, causes spray application to be delayed until such time as the splice reaches the applicator 38 and continues the spray application until the desired number of revolutions for passage plus the additional 9 revolutions have been completed. Those skilled in the art can appreciate that the number of revolutions required for the splice to pass through the press P is dependent upon many variables and must be selected based upon experience. For this reason, the local controller connected to the splice operator permits adjustment of the passage and clear-up delay. In this way, only defective portions of the web 22 are marked.

Likewise, each of the switches 30, 32, 34 and 36 is located a known distance from the spray applicator 38. During the clearing of a dust particle or the like from one of the cylinders, an additional operator defect is normally caused which al must be cleared. Typically, the press operator will utilize a short length of plastic to clear the hickie-causing particle or the like from the rotating print cylinder and passage of this plastic along the periphery of the print cylinder will also cause a print defect. Applicant has learned that approximately 9 revolutions of the print cylinders are required to clear this operator initiated defect. Furthermore, assuming that the press operator (not shown) initially observes the defect on its first occurrence, then those portions of the web preceding the defect are satisfactory and need not be sprayed. Therefore, activation of the switches 30, 32, 34 and 36 initiates a built-in delay in the operation of the spray applicator 38. This assures that the applicator 38 only sprays defective web juxtaposed thereto.

The blanket washers W, on the other hand, because of their close proximity to the spray applicator 38, cause immediate print defect on the web 22. Applicant has discovered that approximately 21 seconds are required for the washers W to clean the associated print cylinders and for the defect caused by operation thereof to be cleared. Therefore, the timer, which is connected to the washer operator, causes the spray applicator 38 to direct the fluorescent fluid to the web 22 for the desired number of seconds to assure proper marking of defective web portions.

Figure 4:
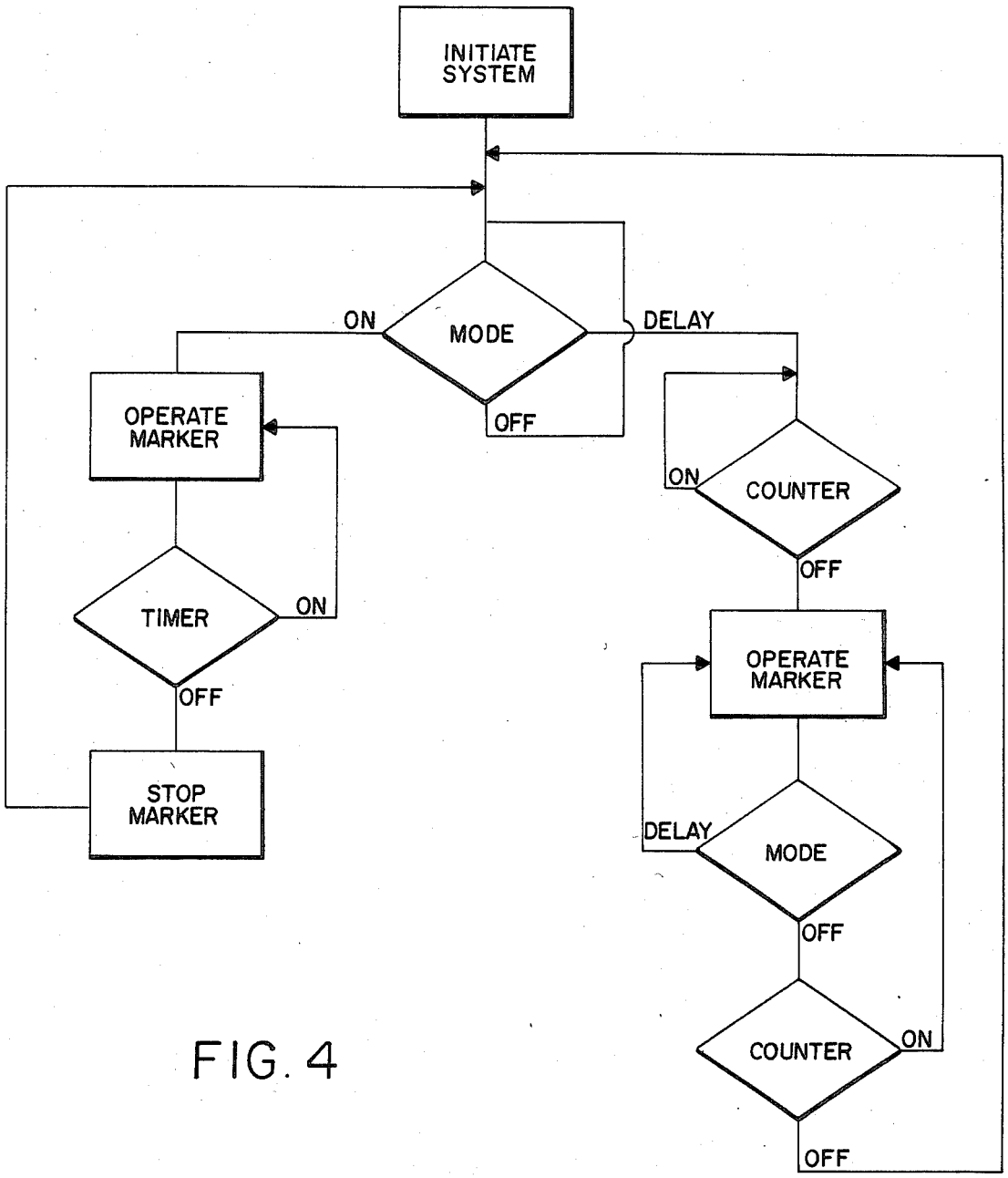

The algorithm for operating the control circuit of the invention is best shown in FIG. 4. The control system is initiated once the press P is operating in accordance with specifications and producing high quality printed web 22. The central controller then makes inquiry of whether any of the switches SW1, SW2, SW3 or SW4, the splice operator or the wash operator have been activated. If none of these defect indicators have been activated, then the system continuously cycles in the off control mode, so that marking is prevented. On the other hand, should one of the switches SW1, SW2, SW3 or SW4 or the splice operator have been activated, then the system is placed into the delay control mode.

In the delay control mode, the algorithm inquires of the counters whether the defect indicated by the particular switch or the splice operator has reached the spray applicator 38. Because the speed of the print cylinders and distance from the respective switches and operator to the applicator is known, the counters monitor the number of revolutions and indicate to the central controller whether the required number of revolutions for passage have occurred since activation of the switch or operator. If not, then the system cycles until passage of the defect to the applicators 38 or 41 has occurred. Once the desired number of revolutions required for the defect to have reached the spray applicator 38 have elapsed, then the spray applicator 38 directs the fluorescent fluid 50 to the web 22. As is known, the switches SW1, SW2, SW3 and SW4 are manually operated and the operator deactivates the switches upon the defect being cleared, as well as any operator initiated defect. Likewise, once the splice has been made by the splicer 26, then the splice operator is also deactivated. Should those devices be deactivated, then the counter C is again inquired of to determine whether the proper number of revolutions have elapsed for the defective portions of the web to have cleared the applicator 38. If not, then the marker 38 continues to operate. Likewise, if the indicating devices have not been deactivated, then the marker continues to operate. Should the desired number of revolutions have occurred, then marking is stopped and the system returns to the inquiry status.

The washer operator, on the other hand, is an automatic operator mandating instantaneous operation of the spray applicator 38. In this case, when the system is in the "on" mode, the central controller immediately initiates operation of the marker and activates the timer. The timer continues to run for the predetermined time period and, during that time, the marking continues. Once the selected time has elapsed, then the spray applicator 38 is turned off and the system returns to the normal inquiry status, the off mode.

OPERATION

Operation of the disclosed invention is straightforward and can be performed by relatively unskilled press operators, it merely being necessary that the press operator be able to recognize the apparent cause of any observed defect.

Should the press operator (not shown) observe a defect originating with one of the print cylinders 10, 12, 14, and 16, then he need merely activate the associated one of the switches 30, 32, 34 and 36 in order to cause the marking system to commence delayed operation. As previously explained, spray application by the applicator 38 does not commence until the defect causing activation and requiring marking has reached the applicator 38. Then, spray application commences and continues until such time as the same switch is deactivated and the desired number of revolutions for passage through press P has occurred. After this has occurred, then the spray applicator 38 ceases operation and no longer marks the web 22. Therefore, it can be seen that activation of any of the switches 30, 32, 34 and 36 causes the delayed operation of the spray applicator 38 because commencement of the marking operation is delayed until the defect is juxtaposed with the applicator 38. Cessation of application is likewise delayed in order to take into account the distance of the associated print cylinder from the applicator 38.

Likewise, the splice operator, which is activated upon the splicer 26 commencing operation, also causes the system to be shifted into the delayed operation mode. In this case, spray application does not commence until the resulting splice of the web 24 with the web 22 reaches the applicator 38. Then, spray commences and continues until the desired number of clear-up revolutions have occurred.

The washer operator is an automatic operator which immediately causes spray application. Typically, an external controller will cause the blanket washers W to periodically operate, generally every 3 minutes and with a wash and clear-up period of 21 seconds. When operation occurs, then the timer and spray application immediately commence. An experimentally determined time is required for clear-up of the print cylinders 10, 12, 14 and 16 after washing by the washers W and this time is built into the timer, as well as the operation time of the washers W.

From the above, it can be seen that the method and apparatus of the disclosed invention provides an efficient and easy to operate marking system which assures that only defective portions of the printed web are marked, while still maintaining proper operation of the printing press P. The system is advantageously utilized with a central microprocessor which therefore permits the controllers and the timer to be programmed into the algorithm, rather than requiring external hardware. The disclosed invention can be advantageously practiced on existing printing presses and does not require additional training of the press operators. While the preferred embodiment discusses utilization with a printing press, those skilled in the art can appreciate that the invention has practical application to other multiroll processes operating on means wherein defects cannot be tolerated.

While this invention has been described as having a preferred design, it is understood that it is capable of further modifications, uses and/or adaptations of the invention and following in general the principle of the invention and including such departures from the present disclosure has come within known or customary practice in the art to which the invention pertains, and as may be applied to the central features hereinbefore set forth, and fall within the scope of the invention of the limits of the appended claims.

What I claim is:

1. The method of marking defective web portions with a web marker operated by a controller to permit easy sorting, comprising the steps of:

(a) signaling to a controller detection of a defective web portion by means of a manual or an automatic operator;

(b) instantaneously operating a web marker and continuing to operate said marker for a predetermined time so that said marker marks the web when said controller is signaled by said automatic operator; and, (c) delaying operation of said web marker for a predetermined period sufficient to permit the defective portion to be juxtaposed with said marker when said controller is signaled by said manual operator and continuously marking the defective web portion thereafter by operation of said marker means until web containing no defect is juxtaposed with said marker after said manual operator signals to said controller that a defect is no longer being detected.

2. The method of claim 1, including the further step of:

(a) illuminating the marked portions of said web and removing defective portions.

3. The method of claim 1, including the steps of:

(a) marking said web portion with a fluid; and, (b) drying said fluid.

4. The method of claim 2, including the steps of:

(a) marking said web portion with a fluorescent fluid;

(b) drying said fluid; and (c) illuminating said dried fluid with light of a selected spectrum.

5. A control system for a web printing press defect marker , the press having plural print rolls, the control system comprising:

(a) a central controller for being operably associated with a web marker for controlling operation of the web marker;

(b) counter means for being operably associated with one of the rolls and with said controller for monitoring and for signaling to said controller the number of revolutions of an associated roll;

(c) timer means operably associated with said controller for monitoring and signaling to said controller elapsed time;

(d) a manually operable switch operably associated with said controller and with said counter means and for being operably associated with the press so that operation of the web marker is delayed for a predetermined number of revolutions of the print rolls when said switch is activated and cessation of operation is delayed for a predetermined number of revolutions of the print rolls after deactivation of said switch; and, (e) an automatic operator operably associated with said controller and with said timer means and for being operably associated with the press for causing substantially instantaneous operation of the marker upon activation of said operator and for causing continued operation for a predetermined time.

6. The system of claim 5, wherein:

(a) means being operably associated with said switch for permitting adjustment of the number of revolutions associated with said delay.

7. The system of claim 5, wherein:

(a) means being operably associated with said operator for permitting adjustment of said predetermined time period.

8. The system of claim 5, wherein:

(a) a plurality of manually operable switches being operably associated with said controller and with said counter means, each of said switches being associated with one of the rolls for indicating detection of a defect associated with the associated roll; and, (b) means being operably associated with each of said switches permitting adjustment of the number of revolutions associated with the associated delay so that said controller only operates the marker when a defective portion of the web is juxtaposed thereto.

9. A printed web defect marker for a web printing press having plural print rolls, comprising:

(a) web marker means downstream of at least one of the rolls for marking defective portions of a web printed by the press;

(b) control means operably associated with said marker means for selectively operating said marker means, said control means having off, delay and on control modes whereby said marker means does not mark the web when said control means is in said off mode, marking of the web commences upon expiration of a predetermined period upon shifting of said control means from said off to said delay mode and continues thereafter and for a predetermined period after said control means is shifted from said delay to said off mode and marking of the web commences substantially instantaneously upon said control means being shifted from said off to said on mode; and, (c) mode selector means operably associated with said control means for shifting said control means between said modes so that only defective portions of the web are marked.

10. The marker of claim 9, wherein:

(a) counter means being operably associated with at least one of the rolls and with said control means for monitoring the duration and signaling completion of said predetermined periods.

11. The marker of claim 9, wherein:

(a) said mode selector means including a splicer initiation means for operable association with a web splicer and for shifting said control means between said off and delay modes when the splicer splices an end of one web to an end of another web.

12. The marker of claim 9, wherein:

(a) said mode selector means including blanket wash initiation means for operable association with a blanket washer system for cleaning the rolls and said blanket wash initiation means for shifting said control means between said off and said on mode when said blanket wash system commences operation.

13. The marker of claim 12, wherein:

(a) timer means being operably associated with said control means for shifting said control means from said on to said off mode upon expiration of a predetermined time.

14. The marker of claim 9, wherein:

(a) said mode selector means including a manually operable switch adjacent to one of the print rolls for shifting said control means between said off and delay modes.

15. The marker of claim 9, wherein:

(a) said mode selector means including a plurality of manually operable switches, each of said switches being proximate one of the print rolls and being adapted for shifting said control means between said off and delay modes.

16. The marker of claim 15, wherein:

(a) period adjustment means being operably associated with each of said switches for establishing said predetermined periods.

17. The marker of claim 9, wherein:

(a) said marker means including spray applicator means for applying a fluid to the web.

18. The marker of claim 17, wherein:

(a) means being operably associated with marker means for adjusting the direction of spray of said applicator means.

19. The marker of claim 17, wherein:

(a) fluid illuminating means being disposed downstream of said applicator means and adjacent to the web for causing the fluid to be visible.

20. The marker of claim 9, wherein:

(a) said marker means being disposed downstream of a last one of the rolls.

21. The marker of claim 9, wherein:

(a) said marker means including first and second web markers;

(b) said first web marker adapted for applying a fluorescent fluid to the web; and, (c) said second web marker adapted for applying a visible fluid to the web.

* * * * *